US010201744B2

(12) United States Patent
Abdelmalek

(10) Patent No.: US 10,201,744 B2
(45) Date of Patent: Feb. 12, 2019

(54) STITCHLESS DORSAL PADDING FOR PROTECTIVE SPORTS GLOVES AND OTHER PROTECTIVE GEAR

(71) Applicant: Anthony Abdelmalek, Baltimore, MD (US)

(72) Inventor: Anthony Abdelmalek, Baltimore, MD (US)

( * ) Notice: Subject to any disclaimer, the term of this patent is extended or adjusted under 35 U.S.C. 154(b) by 398 days.

(21) Appl. No.: 14/602,915

(22) Filed: Jan. 22, 2015

(65) Prior Publication Data

US 2015/0202521 A1 Jul. 23, 2015

Related U.S. Application Data

(60) Provisional application No. 61/930,311, filed on Jan. 22, 2014.

(51) Int. Cl.

| | |
|---|---|
| ***A63B 71/14*** | (2006.01) |
| ***A41D 19/015*** | (2006.01) |
| ***A41D 13/015*** | (2006.01) |
| *A63B 102/24* | (2015.01) |
| *A63B 102/14* | (2015.01) |

(52) U.S. Cl.

CPC ..... *A63B 71/141* (2013.01); *A41D 13/0156* (2013.01); *A41D 19/01523* (2013.01); *A41D 2600/10* (2013.01); *A63B 2102/14* (2015.10); *A63B 2102/24* (2015.10)

(58) Field of Classification Search

CPC ..... A41D 19/01523
USPC ..... 2/16, 20, 161.1, 161.6, 163
See application file for complete search history.

(56) References Cited

U.S. PATENT DOCUMENTS

| | | | | |
|---|---|---|---|---|
| 5,581,809 | A * | 12/1996 | Mah | A41D 19/01523 2/161.1 |
| 7,003,806 | B1 * | 2/2006 | Kleinert | A63B 71/143 2/159 |
| 2008/0263738 | A1 * | 10/2008 | Shamis | A41D 19/01523 2/16 |
| 2010/0071114 | A1 * | 3/2010 | Jaeger | A41D 19/01523 2/161.6 |
| 2010/0077526 | A1 * | 4/2010 | Smeltzer | A63B 71/148 2/16 |
| 2012/0159681 | A1 * | 6/2012 | Gibby | A41D 13/0156 2/20 |
| 2014/0137305 | A1 * | 5/2014 | Fisher | A41D 19/01517 2/20 |
| 2015/0033441 | A1 * | 2/2015 | Wilkening | B29D 99/0067 2/161.1 |
| 2015/0047087 | A1 * | 2/2015 | Contant | A63B 71/143 2/16 |
| 2015/0047089 | A1 * | 2/2015 | Chambers | A63B 71/143 2/20 |

* cited by examiner

*Primary Examiner* — Katherine Moran
(74) *Attorney, Agent, or Firm* — Gordon Feinblatt LLC; Royal W. Craig

(57) ABSTRACT

A protective glove having a unitary dorsal panel formed from an inner scrim material and a plurality of protective elements molded directly to an exterior surface of the inner scrim. The plurality of protective elements are formed in an array of discrete islands each separated by zero-elevation interstitial spaces. The unitary dorsal panel is sewn or otherwise attached circumferentially to the palmer sections of the glove. This array provides increased protection to the user's fingers, hands, wrists, and lower forearms while maintaining flexibility and tactile feel on both palmar and dorsal sides of the glove, increasing flexibility where needed without compromising protection.

15 Claims, 8 Drawing Sheets

A

B

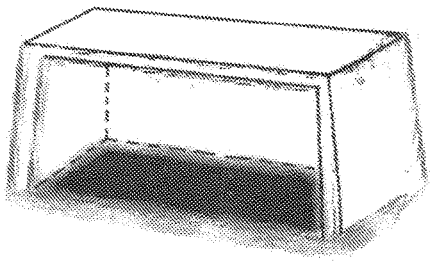
FIG. 8(a)
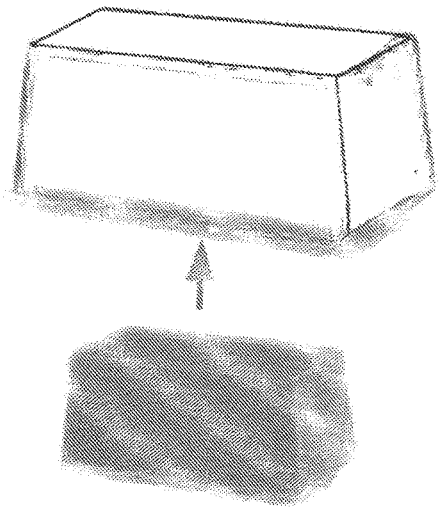
FIG. 8(b)
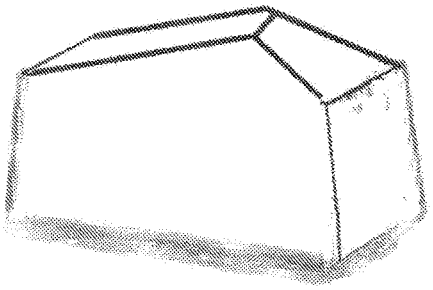
FIG. 8(c)
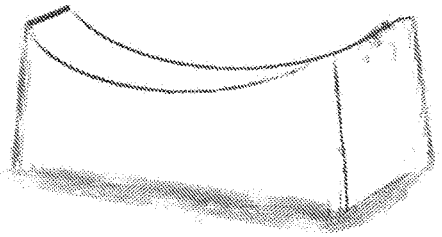
FIG. 8(d)
FIG. 8

STITCHLESS DORSAL PADDING FOR PROTECTIVE SPORTS GLOVES AND OTHER PROTECTIVE GEAR

CROSS-REFERENCE TO RELATED APPLICATION(S)

The present application derives priority from U.S. provisional patent application No. 61/930,311 filed Jan. 22, 2014.

BACKGROUND OF THE INVENTION

1. Field of the Invention

The present invention relates generally to padding for lacrosse gloves and other athletic apparel and accessories, and more particularly, to a protective sports glove and stitch less dorsal padding for the same that provides improved flexibility, increased protection, finer tactile feel and economy of manufacture.

2. Description of the Background

Protective sports gloves are commonly used and, indeed, are required to be used in many organized sports such as lacrosse, hockey, and other contact sports. Such gloves protect the wearer from impact of lacrosse sticks, hockey sticks, balls, pucks, skates, and other players.

Protective sports gloves include padding to protect the player's fingers, hands, wrists and lower forearms. Despite their protective function, such gloves must balance other design factors such as weight, feel and flexibility. For example, the handling of a lacrosse stick requires a player to hold and control a lacrosse stick handle in specific ways, with many different combinations of hand placement over the length of the handle. A lacrosse player constantly moves his hands along the handle in multiple positions.

In executing game skills, lacrosse players must be able to grip and control the lacrosse stick handle, e.g., "stick handling." Effective stick handling requires a player to constantly reposition his hands along the handle to control the head of the lacrosse stick. For effective stick handling, a lacrosse player needs to maintain utmost flexibility of the hand, a sure grip, and a precise tactile feel for the stick. However, the hand also needs protection and so players typically wear padded gloves to protect their hands and wrists. These gloves usually include foam padding or other protective padding covering the back of a wearer's hand, fingers, and thumb (collectively, "dorsal padding").

Some conventional sports gloves have pad segments (e.g., made of foam) that are covered with leather or synthetic leather and, in the breaks between the segments, are stitched to one another and to a liner material (also known as the scrim). The scrim may be any woven or knit fabric. In these conventional gloves individual foam pads are typically sandwiched between two fabric layers and the layers are sewn together, and to the scrim, between breaks in adjacent pads. However, this conventional construct is relatively thick and fairly rigid in design and compromises flexibility and tactile feel for protection. When such a protective athletic glove undergoes deformation due to normal use by a wearer, adjacent pads come into contact with each other and this arrests/resists further motion. In addition, the inflexibility of the fabric layers and liner resist stretching and further arrests/resists motion. In straining against these forces to maintain a grip on the lacrosse stick, a player tends to lose their tactile feel for the stick, and consequently their stick handling capability. Flexibility can be increased by larger spacing between adjacent pads, but larger spacing compromises protection of the player.

Moreover, conventional stitched dorsal padding unduly complicates the overall glove construction. The individual pads for the dorsal panel are typically sewn together, and the overlapping sewn-layers restrict flexibility. This lack of flexibility makes it very difficult to invert the glove when stitching on the palmar section (the glove is inverted when stitched interior seams are desired). The additional stitching and difficulty in manipulating the glove during manufacturing adds significant time and expense.

What is needed is a protective sports glove and "unitary" dorsal panel for the same that allow for a tightly-packed pad array, yet still provides improved flexibility, increased protection, finer tactile feel, and greater economy of manufacture. For purposes of the present application "unitary" is specifically defined to mean formed as a one-shot molded synthetic panel, or formed by a plurality of such panels integrally joined together by fusion of their synthetic material or by fusion of the protective pads to the underlying scrim material (e.g., RF welding, heat welding, etc.), but not stitched.

The unitary padding array of the present invention provides these advantages and may also be used for helmet liners, head gear (e.g., wrestling), other specialty gloves (e.g., baseball, boxing, biking, golf, lacrosse, equestrian, hockey, etc.), shoulder pads, knee pads, elbow pads, bicycle seats, joint supports (e.g., elbow, wrist, knee, hip, neck, shoulder and ankle), padded garments (e.g., biker shorts, etc.), joint braces (e.g., elbow, wrist, knee, hip, neck, shoulder and ankle), and other general padding and supports.

SUMMARY OF THE INVENTION

In one aspect, a protective glove includes a hand receiving portion that includes a plurality of finger portions, a thumb portion, a metacarpal portion and a wrist portion. The hand receiving portion includes a dorsal side and a palmar side. The dorsal side of the hand receiving portion comprises a unitary dorsal panel formed from an inner scrim material and a plurality of protective elements molded directly to an exterior surface of the inner scrim. The plurality of protective elements are formed in an array of discrete islands each separated by zero-elevation interstitial spaces. This array provides increased protection to the user's fingers, hands, wrists, and lower forearms while maintaining utmost flexibility and tactile feel on both palmar and dorsal sides of the glove, increasing flexibility where needed without compromising protection. Flexibility is desired by the wearer so as to impart freedom of movement to the fingers, hand, wrists and lower forearms needed to maintain an accurate tactile feel for the lacrosse, hockey or other sports stick during a match, while protection is required to reduce injury.

The unitary dorsal panel is sewn circumferentially to the palmer sections of the glove, with or without gussets and/or gusset stitching (for example, gussets are typically sewn between the dorsal and palmar sides of gloves running alongside the fingers). The cut pattern for the palmar section may vary but an embodiment is shown that includes three discrete sections: a finger-receiving section; a palm section, and a thumb section. In accordance with the invention, the palmar section is sewn end-to-end across the dorsal panel, with or without gussets, and the glove is inverted. The finger-receiving section and thumb section are then sewn on and the glove turned outside-in yielding internal seams ("inside stitching"). For this inside stitching the present invention provides an additional advantage. The typical reversing out of gloves dictates a minimum gusset width, which results in a looser fit. The invention facilitates a tighter standard for gusset width, which translates into a tighter fit. Of course, the finger-receiving section and thumb section may alternatively be sewn together exteriorly without inversion ("outside stitching").

The present invention is described in greater detail in the detailed description of the invention, and the appended drawings. Additional features and advantages of the invention will be set forth in the description that follows, will be apparent from the description, or may be learned by practicing the invention.

BRIEF DESCRIPTION OF THE DRAWINGS

Other objects, features, and advantages of the present invention will become more apparent from the following detailed description of the preferred embodiments and certain modifications thereof when taken together with the accompanying drawings in which:

FIG. 8 is a composite illustration (8(*a*), 8(*b*), 8(*c*) and 8(*d*)) of several alternative shapes and configurations of the pads 54, 154, 164 which promote specific performance improvements.

DETAILED DESCRIPTION OF THE PREFERRED EMBODIMENT

Reference will now be made in detail to preferred embodiments of the present invention, examples of which are illustrated in the accompanying drawings. Wherever possible, the same reference numbers will be used throughout the drawings to refer to the same or like parts.

Lacrosse, hockey and other stick-wielding sports gloves need to be able to flex in multiple directions freely in order for players to grip their stick and engage in necessary wrist action while still maintaining an acceptable level of protection. However, as discussed above, conventional glove design limits the amount of flex that is available to a player when they are manipulating a lacrosse or hockey stick. Specifically, conventional protective sports gloves have limited flexion and extension as well as difficult radial and ulnar deviation, and poor dorsiflexion as well. Described herein is a protective sports glove and padding for the same that maximizes flexibility without compromising protection, thereby affording more accurate tactile feel for better stick handling.

An embodiment of the present invention provides a protective sports glove comprising a unitary dorsal panel that includes a molded pattern-array of foam protective pads closely fitted to the hand, and a palmar section stitched to the dorsal section directly or via gussets and/or gusset stitching.

Figure 1:
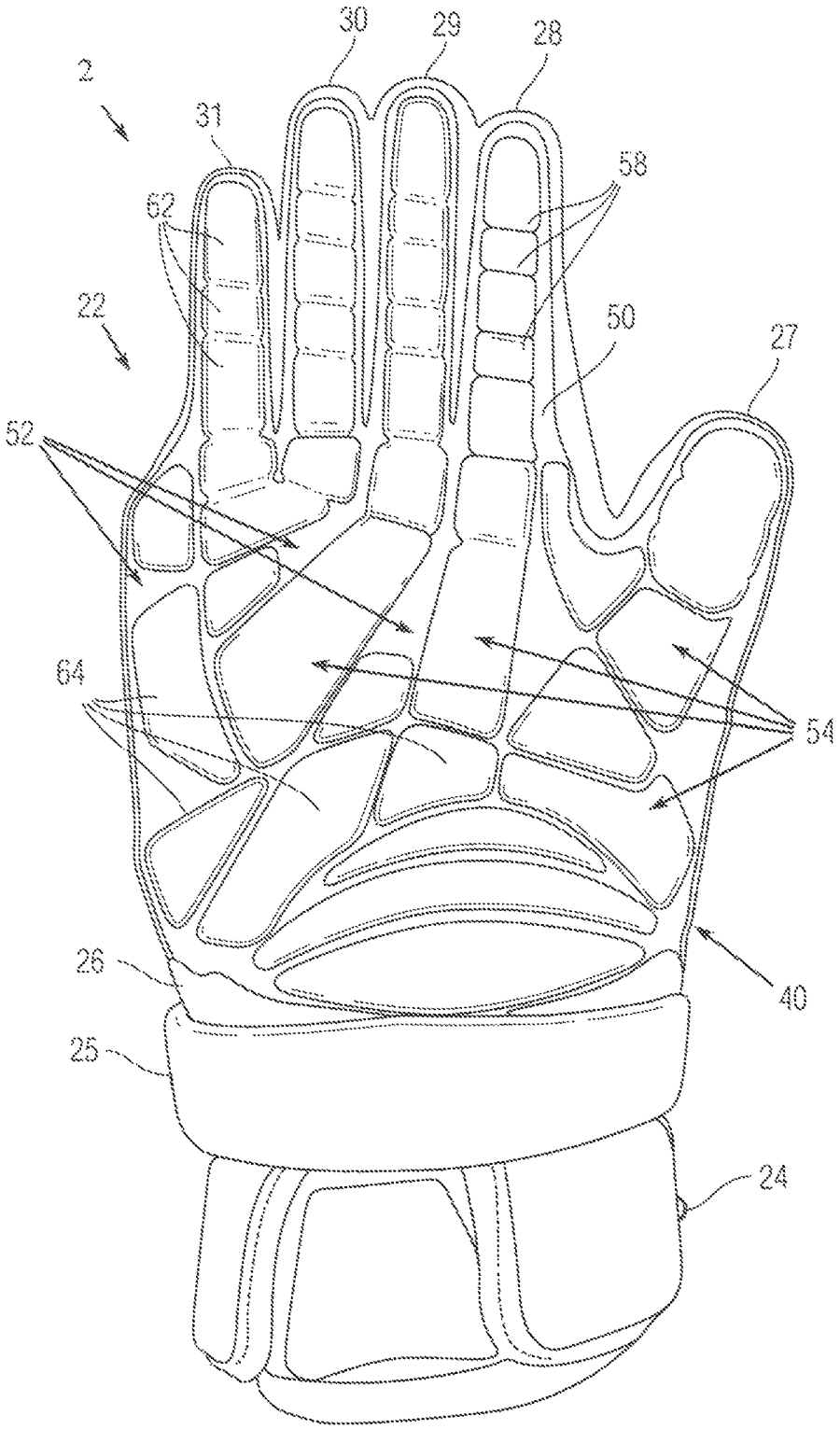
FIG. 1 is a perspective illustration of the dorsal side of a protective sports glove 2 in accordance with an embodiment of the present invention.

With reference to FIG. 1, a first embodiment of a protective athletic glove 2 is shown which generally includes a hand receiving portion 22 covering all five digits and the carpometacarpal joints of the hand and extending down at least to the wrist crease, or further to cover all or a portion of the wrist. A lower wrist/forearm portion 24 extends down from the hand receiving portion 22 by a distance from one to three inches. Glove 2 inclusive of both hand receiving portion 22 and lower wrist/forearm portion 24 has both a palmar side (obscured) and a dorsal side (shown). The junction of the hand receiving portion 22 and lower wrist/forearm portion 24 is partially encircled by a cuff inclusive of a wrist cushion 25 that partially surrounds the dorsal side and an adjustable collar 26 that extends below the hand receiving portion 22 and which may be tightened across the palmar side by hook-and-loop pads. The hand receiving portion 22 further includes a first (little finger) receiving portion 31, second (ring finger) receiving portion 30, third (middle finger) receiving portion 29, fourth (index finger) receiving portion 28, and a fifth (thumb) receiving portion 27.

The back of the hand receiving portion 22 inclusive of finger and thumb receiving portions 27-31, as well as the entire dorsal side down to the lower wrist/forearm portion 24 comprises a unitary dorsal panel 40 having an array of protective pads 54 formed as individual islands raised from a zero-elevation surface 52. Protective pads 54 are integrally-molded or fused to the zero-elevation surface 52 such that interstitial channels of minimal substrate thickness are formed between the discrete pads 54. In the embodiment of FIG. 1 the zero-elevation surface 52 comprises a thin pliable layer of any suitable scrim material. The scrim material may be any pliable textile or synthetic sheet material including natural or synthetic fabric, and may optionally be porous and/or stretchable. Suitable materials for the scrim material include polyester, cotton, and nylon. The scrim material of zero-elevation surface 52 may be woven from warp and weft threads which provide mesh openings or interstices between the threads. However, other scrim materials, such as, for example, perforated fabric, can also be used so long as the scrim material permits the pads 54 to bond or adhere with the scrim material.

The scrim material may or may not have a limited stretch characteristic to it. Toward this end scrim material may be cut from a knitted/woven stretchable fabric blank comprising a material formed from a combination of first yarn strand(s) made of synthetic fibers, and a second elastomeric stretchable yarn strand. The first yarn strands are knitted/woven together with the elastomeric second strand to create a single blank of woven/knitted fabric. The knitted/woven blank has a specific fiber content vis-à-vis the combination of the two strands of yarn used. The first yarn strands may be 1000% polyester, which is the dominate fiber of the fabric blank. As an alternative to polyester, the first yarn strands may comprise nylon. The second elastomeric yarn strand may be comprised of any elastic textile fiber, however, it is preferred that this material be made of the elastomeric textile fiber known as spandex. Specifically, the knitted/scrim material may comprise a blend of polyester or poly-cotton yarn and spandex, wherein the spandex fiber content is constrained to within an acceptable range of from 3 to 15%, and most preferably is 6%. This may be achieved with a knit/ weave ratio of synthetic yarn/spandex yarn of from 33:1 to 20:1, and identical deniers. One skilled in the art will understand that the variation between fabric blends may also be made possible by varying the ratio of yarns and the structure of the knit or weave pattern.

The array of integral pads 54 formed on the unitary dorsal panel are raised relative to zero-elevation surface 52 and are formed integrally thereto by a process of sonic (RF) welding as described below in Example 1. Alternatively, the array of integral pads 54 may be formed on the unitary dorsal panel by a process of compression molding as described below in Example 2, or may be individually attached to the scrim material by adhesive. In either case the protective pads 54 comprise rubber and/or foam, most preferably open-cell or closed-cell foam rubber blocks fused or integrally-molded to the scrim material by molding, casting or other suitable fusion method. The pads 54 form discrete islands separated from each other by interstitial channels 58 flush with zero-elevation surface 52.

Figure 2:
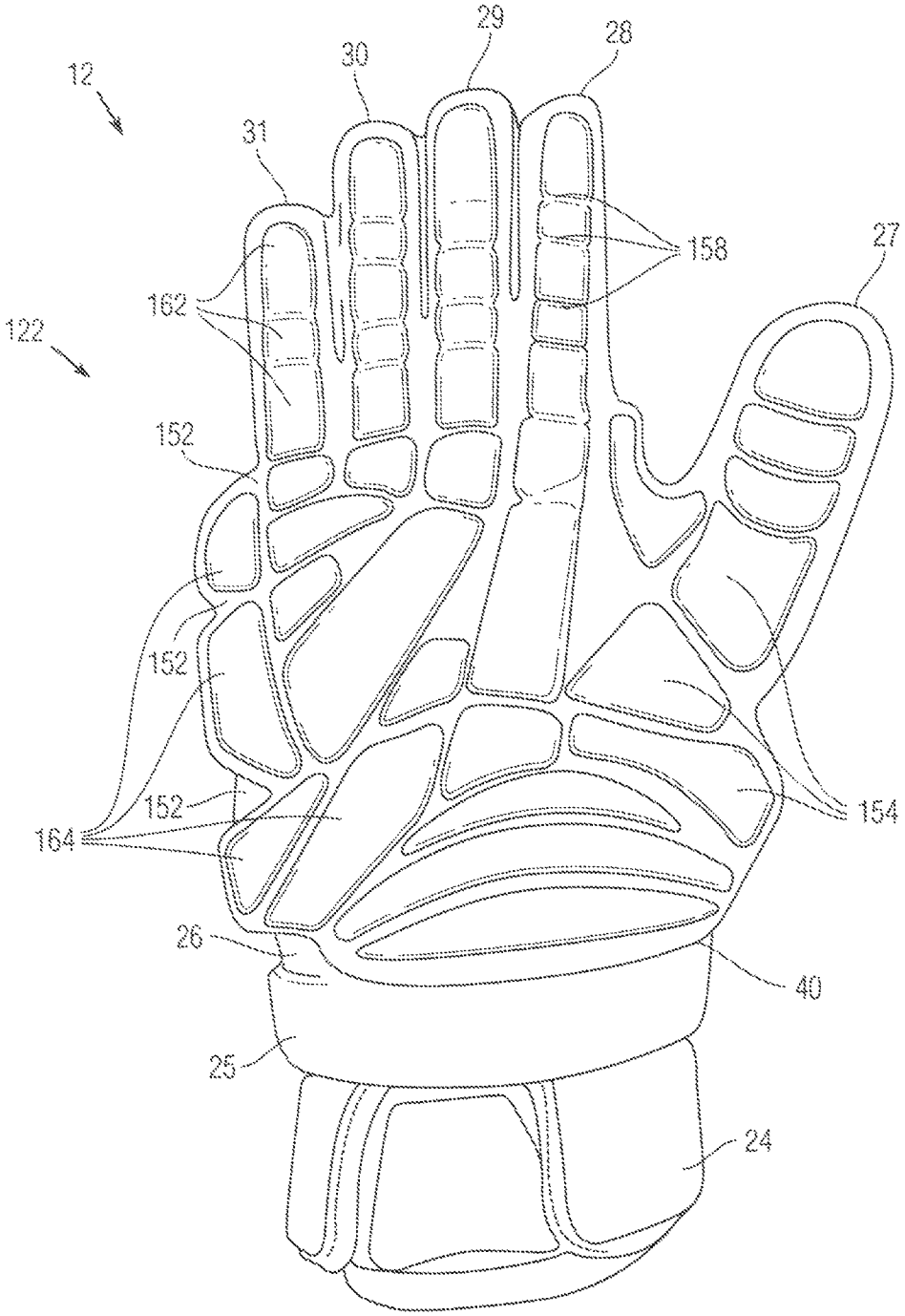
FIG. 2 illustrates a second embodiment of a protective athletic glove 12 similar to FIG. 1 except formed by compression molding.

FIG. 2 illustrates a second embodiment of a protective athletic glove 12 similar to FIG. 1 except that a unitary dorsal panel 140, again having a zero-elevation surface 152 and array of integral pads 154, is formed by compression molding as described below in Example 2.

In both cases the array of integral pads 54, 154 are formed on the unitary dorsal panel 40, 140 by molding/fusing/adhering them into the scrim fabric. The particular pattern of shock absorbing pads 54, 154 is designed to provide increased protection to the dorsal side of the user's fingers and hands while maintaining as much flexibility within the glove and tactile feel as possible. Flexibility is desired by the wearer so as to impart freedom of movement to the fingers, hand, wrists and lower forearms needed to properly participate in lacrosse, hockey or other sports matches while protection is required to reduce injury.

In the illustrated embodiment each of the shock absorbing protective pads 54, 154 are shaped as blocks and most preferably a trapezoidal prism. However, the particular shapes of the pads 54, 154 may be altered to promote specific performance improvements. Other exemplary shapes and configurations of pads 54, 154 for specific performance improvements are described below with reference to FIG. 8:

i. Pads 54, 154 may be hollow concave blocks having open cavities in the underside for lighter weight (see FIG. 8(*a*));

ii. Hollow concave pads 54, 154 may be dual-durometer, e.g., the open cavities in the underside as per (i) above may be adapted for insertion of stiffer impact-resistant material for improved protection (see FIG. 8(*b*));

iii. Pads 54, 154 may be formed with angled top surfaces for improved deflection of impacts (see FIG. 8(*c*));

iv. Pads 54, 154 may be formed with shaped and/or sculpted surfaces to conform to a lacrosse stick handle (see FIG. 8(*d*));

v. Pads 54, 154 in the lower wrist/forearm portion 24 may be formed with angled surfaces for improved wrist flexibility (see FIG. 8(*c*)).

Of course, one skilled in the art should understand that pads 54, 154 may be formed in other shapes or with other surface features or inserts as a matter of design choice to achieve specific performance characteristics, and such other shapes, surface features or inserts are considered to be within the scope and spirit of the invention.

Comfort is also important and toward this end venting may be provided through the scrim material between the discrete pads 54. Specifically, said the scrim material may include one or more pass-through vents between the discrete pads 54 for improved air circulation.

Figure 3:
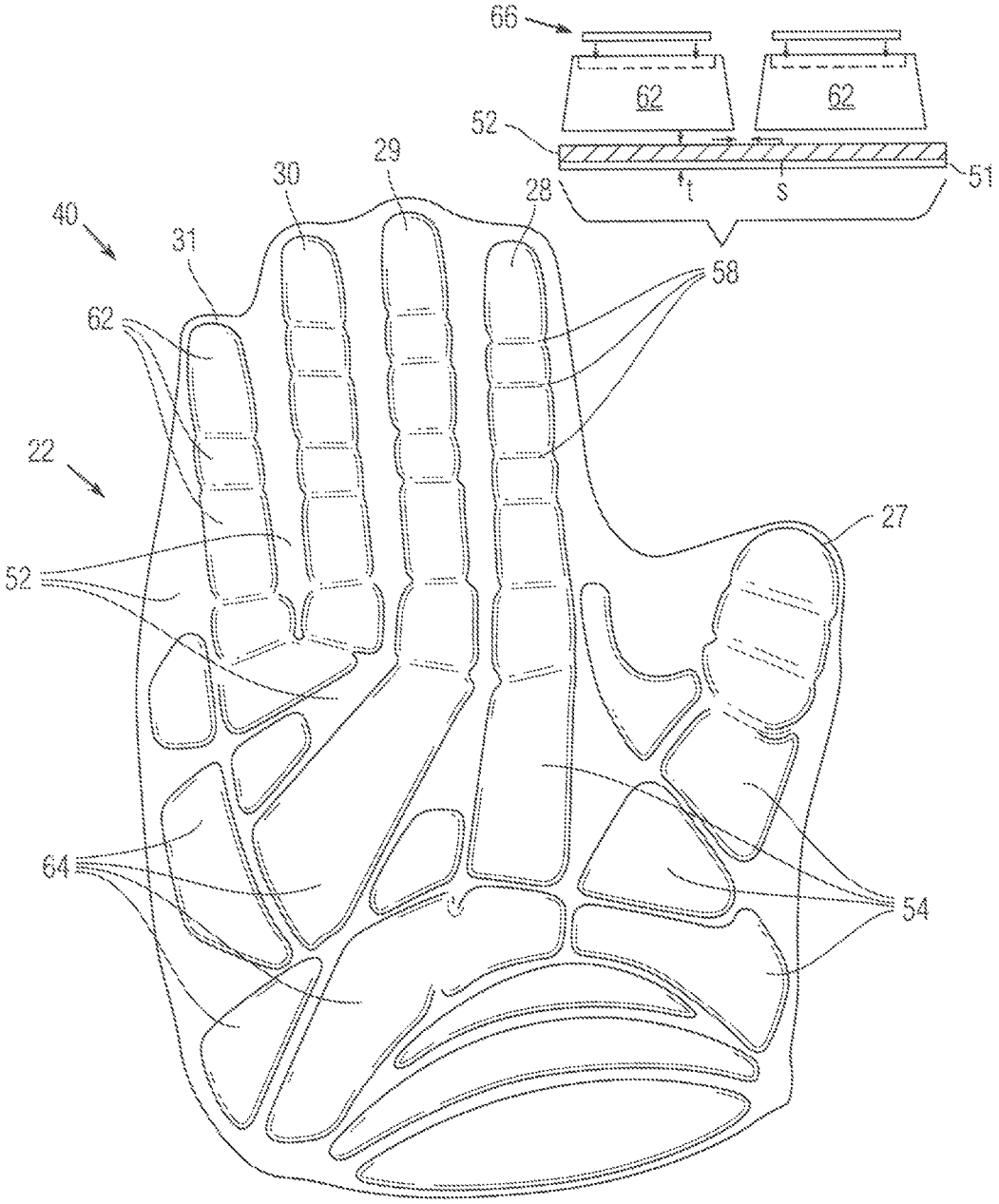
FIG. 3 illustrates the pattern on the dorsal section of glove 2 for the embodiment of FIG. 1.

FIG. 3 illustrates the pattern on the dorsal section of glove 2 for the embodiment of FIG. 1. Each of the finger receiving portions 28-31 and thumb receiving portion 27 bear a plurality of shock absorbing pads formed as blocks. With reference to the little finger receiving portion 31, these pads 62 are preferably aligned end-to-end and are spaced very closely, within a range of from 1-4 mm and most preferably approximately 1 mm. The 1 mm interstitial breaks provide flexibility between the cushions when a wearer's hand is flexed. The faces of opposing pads 62 can be inclined at an obtuse angle to allow a limited degree of counter-arching of the fingers, but eventually make contact to prevent over-arching. A variety of pads 64 occupy the dorsal panel beneath the finger receiving portions 28-31 and these are also welded or otherwise attached to the liner scrim beneath. Any suitable geometry of shock absorbing pads 64 may be provided to optimize both protection and flexibility.

All shock absorbing pads 62, 64 are generally made of a discrete block of any suitable protective material such as micro-cellular foam, preferably open cell, urethane foam (e.g., Poron™, PVC nitrile foam, or another suitable impact-absorbing closed cell foam material). The interstitial channels 58 are of minimal substrate thickness and spacing between the discrete pads 54. In the embodiment of FIGS. 1 and 3 the zero-elevation surface 52 comprises a thin single layer of suitable scrim material, and the scrim effectively forms flexible hinges at the interstitial channels 58 between the discrete pads 54. This is best seen in the inset of FIG. 3. Specifically, the thickness of the scrim t at the interstitial channels 58 is preferably on the order of 0.1-4.0 mm, and is most preferably approximately 0.4 mm. If desired, a very thin layer of Ethylene-vinyl acetate (EVA) foam 51 may be added to the back (lower) side of the scrim material 52, or other suitable adhesion promoter, to improve adhesion of the discrete pads 54 (see FIG. 3 inset) on the front (upper) side of scrim material 52. Discrete pads 54 are preferably molded EVA foam blocks ranging from 9 mm to 13 mm in thickness. Thus, the layers in the illustrated embodiment comprise (moving from hand to outside of glove):

Layer 1—optional thin layer of EVA adhered to scrim material 52 (1 mm preferred);

Layer 2—scrim material 52 (0.1~1.0 mm thickness, 0.4 mm preferred);

Layer 3—Discrete EVA pads 54 ranging from 9 mm to 13 mm thickness.

The interstitial channel spacing s between the discrete pads 54 is preferably on the order of 0.5-5.0 mm, and is most preferably approximately 1 mm. If desired, optional hard shell tiles 66 formed of polyethylene, Nylon or other suitable impact-resistant material may be inset/adhered or otherwise formed in the top surface of each discrete pad 54 to add impact resistance.

As seen in FIGS. 1-2 the lower wrist/forearm portion 24 is defined by a cuff attached below the hand receiving portion 22, the cuff comprising a wrist cushion 25 that partially surrounds the dorsal side and an adjustable collar 26 that extends below the wrist cushion 25 and which may be tightened across the palmar side by hook-and-loop pads, or alternatively by traditional string lacing for wrist cuff closure.

Figure 4:
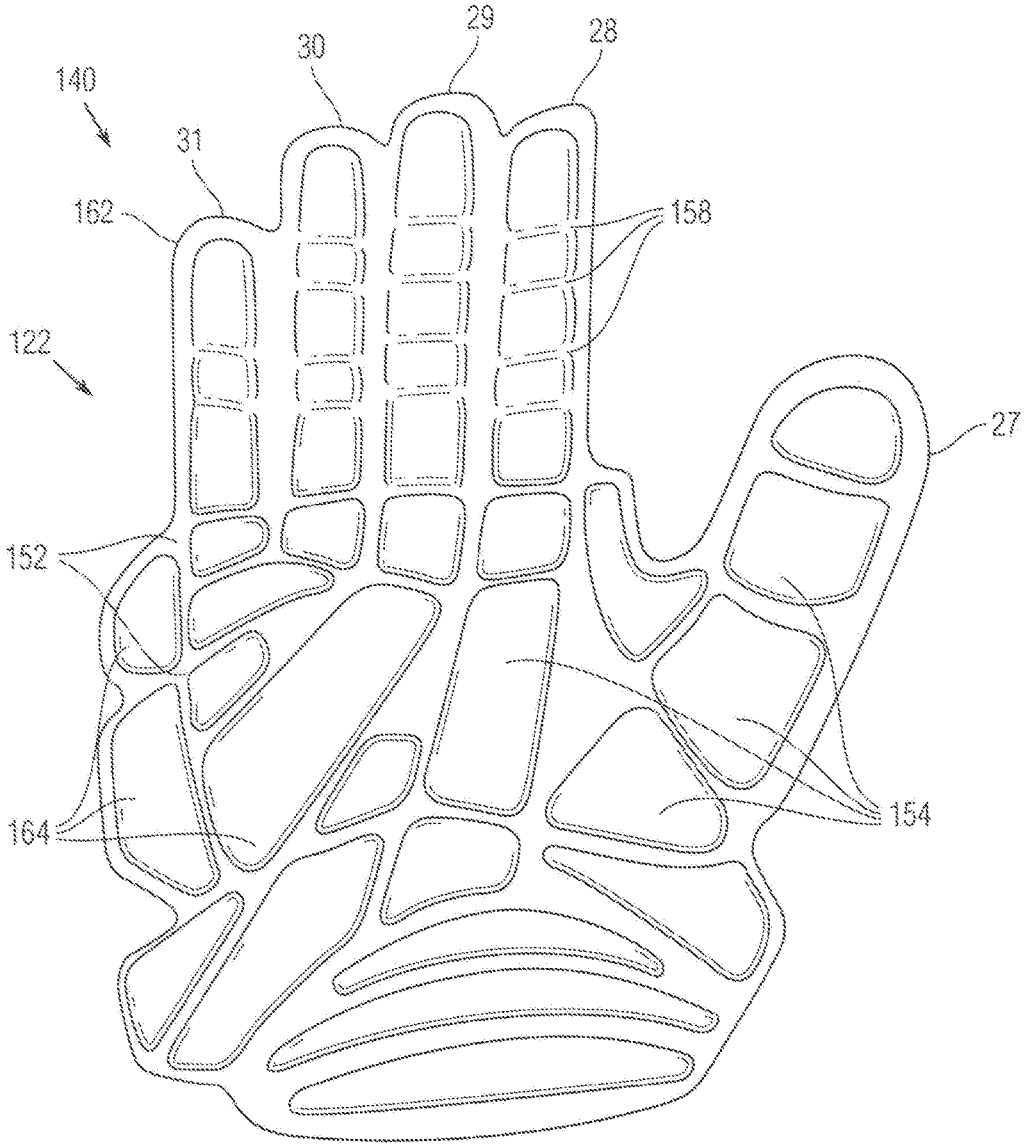
FIG. 4 illustrates the pattern on the dorsal section of glove 12 for the embodiment of FIG. 2.

FIG. 4 illustrates the pattern on the dorsal section of glove 12 for the embodiment of FIG. 2. As above each of the finger receiving portions 28-31 and thumb receiving portion 27 bear a plurality of shock absorbing protective pads 162, that are shaped as blocks and may be formed as blocks and may be formed as trapezoidal prism. With reference to the little finger receiving portion 31, these pads 162 are preferably aligned end-to-end and are spaced closely, within a range of from 1-4 mm and most preferably approximately 1 mm. The 1 mm interstitial breaks provide flexibility between the cushions when a wearer's hand is flexed. The faces of opposing pads 162 are preferably inclined at an obtuse angle to allow a limited degree of counter-arching of the fingers, but eventually make contact to prevent over-arching. A variety of pads 164 occupy the dorsal panel beneath the finger receiving portions 28-31 and these are also integrally molded to the liner scrim 152 beneath. All pads 162, 164 are preferably compression-molded or otherwise fused to the zero-elevation surface of scrim 152 using any suitable protective material such as micro-cellular foam such as, for example, open cell, urethane foam (e.g., Poron™, PVC nitrile foam, or another suitable impact-absorbing closed cell foam material). Compression-molding as per the embodiment of FIGS. 2 and 4 impregnates the scrim fabric 152 and adds very slightly to the dimensions of interstitial channels 158, but channels 158 are nevertheless of minimal substrate thickness and spacing between the discrete pads 154. In the embodiment of FIGS. 2 and 4 the zero-elevation surface 152 comprises a thin unstitched rubber and/or foam-impregnated layer of scrim material that again effectively forms flexible hinges at the interstitial channels 158 between the pads 154. Specifically, the thickness of the scrim t at the interstitial channels 158 is preferably on the order of 0.1-1.0 mm, and is most preferably approximately 0.4 mm. The channel spacing s between the discrete pads 154 is preferably on the order of 0.5-5.0 mm, and is most preferably approximately 1 mm.

In both above-described embodiments, the pad array is molded onto a square blank of scrim material 52, 152 and the blank may be cut (die, laser, rotary-blade, water-jet, etc.) using an outline cut that results in a substantially contiguous border framing the dorsal panel 40, 140, resulting in the dorsal panels as shown in FIGS. 2 and 4. Preferably, the border surrounding dorsal panel is within a range of from 4-8 mm across, and most preferably a 5-6 mm margin.

Figure 6:
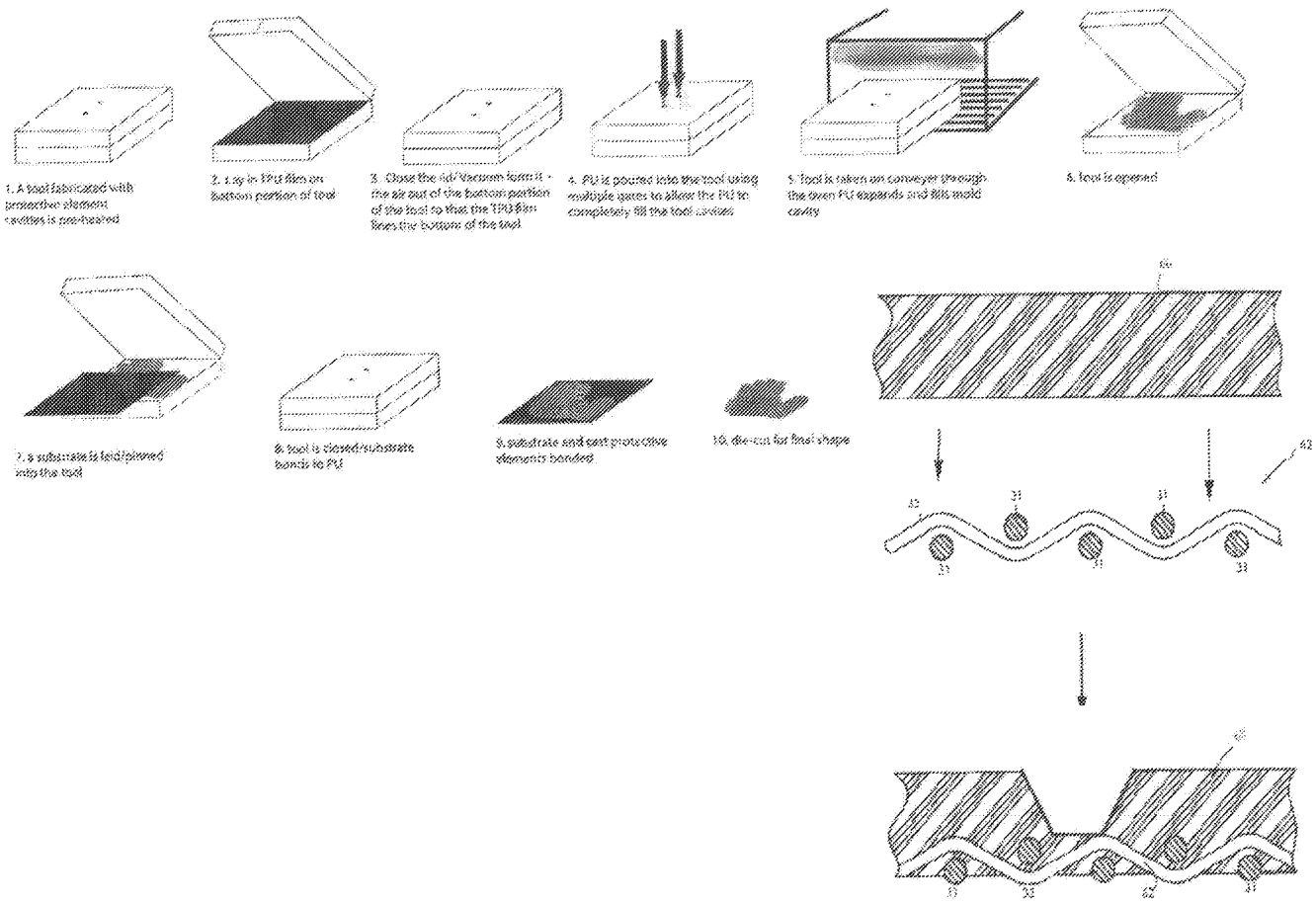
FIG. 6 is a process drawing illustrating the process for making a dorsal section of glove 2 for the embodiment of FIG. 2.

As seen in FIG. 6, the scrim material layer 52, 152 may again be any pliable textile or synthetic sheet material including natural or synthetic fabric, and may optionally be woven from warp and well threads 31 and 32 which provide mesh openings or interstices 33 between the threads 31 and 32. Optionally, perforated or needle punched fabric can also be used so that the fabric is provided with openings which permit the rubber and/or foam to interlock with the fabric. Suitable materials for the fabric include polyester, cotton, and nylon. For purposes of present description "scrim material" is herein defined as a woven or mesh fabric layer.

As detailed below in Example 1 sonic welding causes the rubber/foam to fuse to the scrim material, and where the scrim material is perforated or woven it flows into the mesh openings of the textile scrim fabric 52, 152 and mechanically interlocks with the fabric. The fabric reinforces the rubber/foam, strengthens the rubber/foam especially in the interstitial areas, and reduces the possibility that the dorsal shell will tear.

Example 1: Sonic-Welded Dorsal Panel

Figure 5:
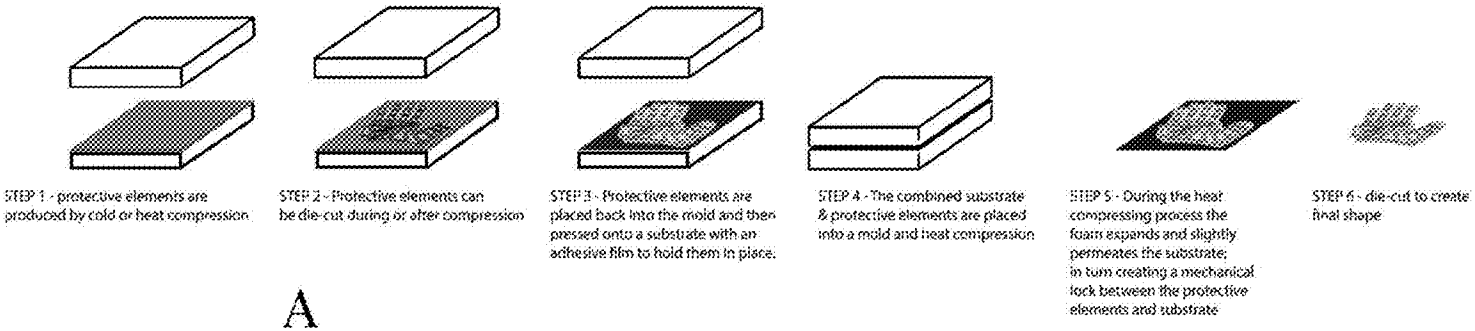
FIG. 5 is a composite process drawing (A & B) illustrating the process for making a dorsal section of glove 2 for the embodiment of FIG. 1.
Figure 5:
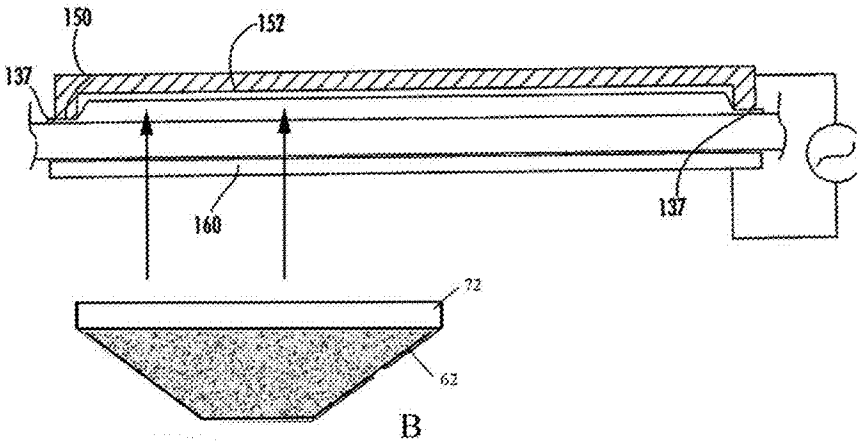

FIG. 5 is a process drawing illustrating the process for making a dorsal section of glove 2 for the embodiment of FIG. 1. Initially, at Step 1 the entire array of protective pads 54 is produced by either cold or heat compression in a tool, for example, cast-in-place by pour-casting into a two-part mold. At step 2, the protective pads 54 can be die-cut either post compression or during compression to attain their finished form. As seen at Step 3 the protective elements are placed back into the tool/mold and pressed onto a substrate using an adhesive film laid overtop pads 54 to keep them registered. As seen at Step 4, the combined film, substrate and protective pads 54 are placed into a flatbed high frequency welding station 100 as seen at B. To perform HF welding, two opposing die platens 150, 160 act as capacitor plates. An oscillating electrical current is applied to the mold 72/fabric blank 62 combination between the die platens 150, 160. The oscillating electrical field in conjunction with capacitive platens 150, 160 converts the oscillating electrical current into an oscillating electric field that is applied to the mold 72/fabric blank 62 combination. The die platens 150, 160 may comprise brass, steel, aluminum/magnesium, or other similar materials. To perform the weld, the die platens 150, 160 are compressed together and the ultrasonic field and combined pressure causes localized melting of the protective pads 54 only at the interface 137 of the scrim fabric and the protective pads 54, resulting in fusing of the pads 54 to the scrim fabric. As shown at Step 5, during the heat compressing process, the foam of the protective pads 54 expands and, with a porous substrate, slightly permeates the substrate, flowing into the mesh openings of the textile scrim fabric 52, 152 and mechanically interlocking with the fabric, creating a unitary bond between the protective elements 54 and substrate. If the substrate is not porous substrate, during the heat compressing process, the foam of the protective elements fuses/adheres to the scrim substrate. The net result is a dorsal panel as illustrated in FIG. 3. At Step 6 the dorsal panel is die cut to the desired shape.

In yet another embodiment, a unitary dorsal section 40 of glove 2 for the embodiment of FIG. 1 can be created using a plurality of independent scrim sections by fusing protective pads 62 via the sonic welding process of FIG. 5 across the multiple sections of scrim material 52 to bridge them, effectively fusing them together.

Example 2: Textile Reinforced Compression Molded Foam Rubber Dorsal Panel

FIG. 6 is a process drawing illustrating the process for making a dorsal section of glove 2 for the embodiment of FIG. 2. Initially, at Step 1*a* mold fabricated with protective element cavities is pre-heated.

At Step 2 an optional thermoplastic polyurethane (TPU) film is laid on the bottom portion of the mold. One skilled in the art should understand that the TPU film may be omitted to reduce manufacturing cost.

At Step 3 the mold is closed and dorsal section of glove 2 is vacuum formed by releasing the air out of the bottom portion of the tool/mold so that the TPU film lines the bottom of the tool. At step 4 polyurethane is poured into the tool/mold using multiple gates, to allow the polyurethane to completely fill the tool cavities.

At Step 5 the tool is put on a conveyer through an oven. The polyurethane thermally expands and fills the tool/mold cavities. At Step 6 the tool is opened. At Step 7 a substrate is laid or pinned into the tool. The substrate may be a rubber and/or foam sheet. At Step 8 the tool is closed and the rubber/foam 66 softens and/or becomes fluid in the mold and as a result of compression flows out of the interstitial channels and into the pad sections, also flowing into the pores of the scrim material 62 and around the threads as illustrated in FIG. 6C. The rubber/foam 66 thereby forms a mechanical interlock or bond with the scrim material 62. When the rubber/foam cools, the fabric is integrated with the rubber/foam.

Moreover, the heat and pressure of molding displaces the rubber/foam into the mold cavities and defines the zero-elevation interstitial surfaces surrounding the array of raised pads 152, each pad forming a raised island on the zero-elevation surface 52. The scrim material 62 strengthens and reinforces the rubber/foam 66. If desired, the foam rubber 66/scrim 62 combination can be molded into a particular shape. For example, the dorsal panel can be provided with a preformed arch to conform to the back of the hand.

Figure 7:
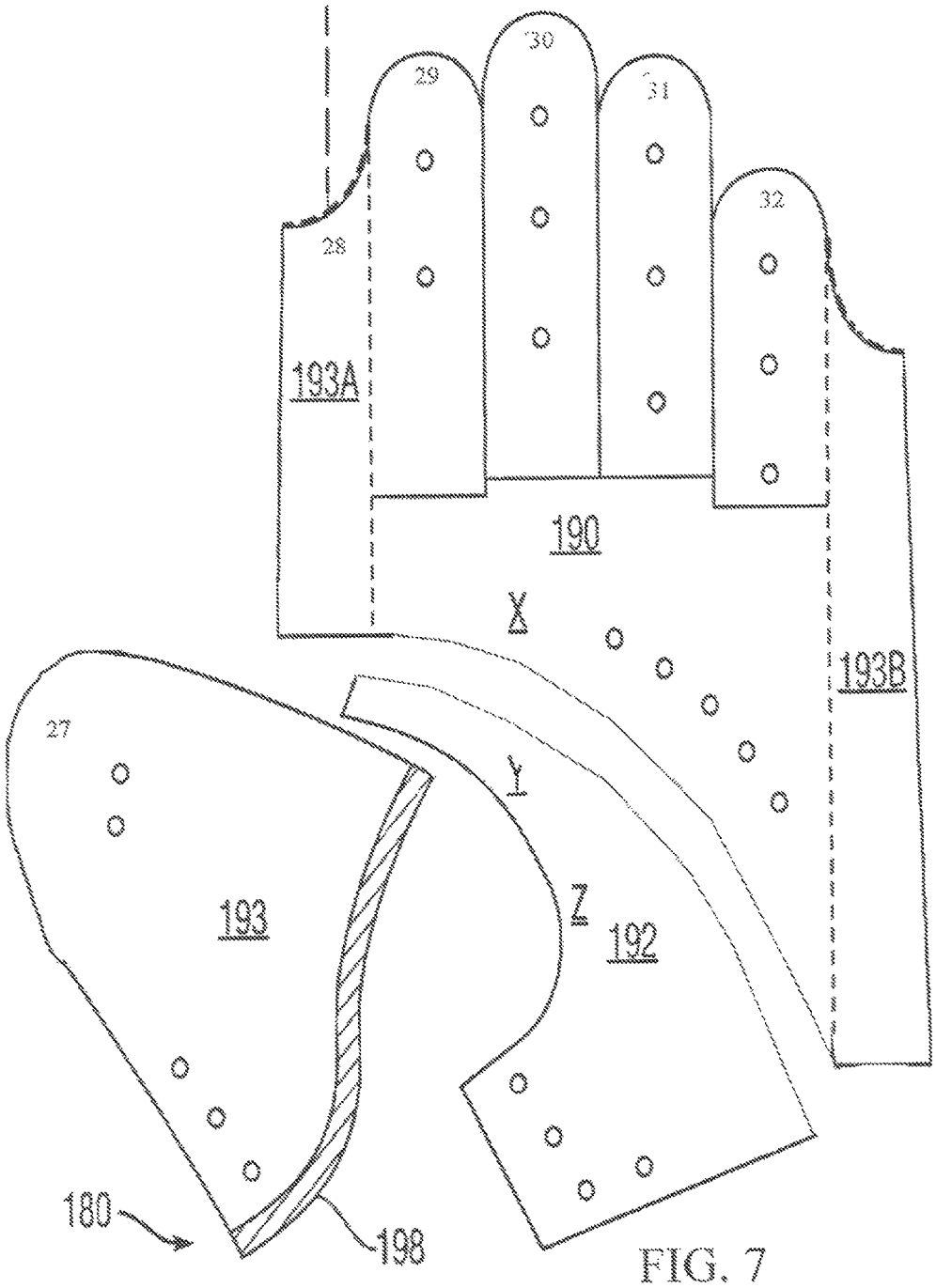
FIG. 7 illustrates an exemplary cut pattern for the palmar section.

The textile reinforced zero-elevation interstitial hinges increase flexibility without compromising protection, thereby affording more accurate tactile feel for better stick handling. The unitary (stitchless) dorsal panels 40, 140 also substantially reduce manufacturing time and expense. Either embodiment of the unitary dorsal panel 40, 140 may be sewn or otherwise attached circumferentially to the palmer sections of the glove. FIG. 7 illustrates an exemplary cut pattern for the palmar section which generally comprises three discrete sections: a finger-receiving section 190; a palm section 192, and a thumb section 193. The palmar section 192 is cut from a blank to define the palmar side of four of the finger receiving portions 28, 29 but not thumb 30. On both sides of the finger-receiving section 190 a protruding margin may be formed 193A, 193B. One skilled in the art should understand that margins 193A, 193B may be convenient for stitching but are non-essential and may be eliminated as a matter of design choice. The margin 193A protrudes outward beginning at the distal phalangeal joint of the index finger-receiving portion 28 and increasingly protrudes outward ending at the metacarpophalangeal joint. The margin 193B protrudes outward beginning at the distal phalangeal joint of the little finger-receiving portion 32 and increasingly protrudes outward ending at the base of the little finger metacarpals bone.

For assembly, the finger-receiving section 190 is frequently inverted and stitched to the inverted dorsal panel 40, 140 by seams, for example, through facing margins 193A, 193B and the margins surrounding dorsal panel 40, 140. The X/Y interface shown in FIG. 7 is not sewn. The palm section 192 is sewn to the inverted finger-receiving section 190 at the X/Y interface. Thumb section 193 is rolled and stitched into a receptacle, and is inverted. The combined finger-receiving section 190 and dorsal section 40, 140, still inverted, is sewn to the still-inverted thumb section 193. The entire assembly is re-inverted to produce the final glove 2, 12 with interior seams.

Since the dorsal panel 40, 140 has highly-flexible interstitial hinges (rather than overlying layers where pads are sewn together, where overlapping sewn-layers restrict flexibility), the combined finger-receiving section 190 and dorsal section 40, 140 are much easier to invert manually. The additional flexibility makes it possible to quickly invert the glove 2, 12 when stitching on the palmar section and saves significant time and expense.

It should now be apparent that the above-described protective sports glove 2, 12 with unitary stitchless dorsal sections 40, 140, allow a user to flex the hand in all directions freely, to grip a lacrosse, hockey or other type of sports stick, and to maintain accurate tactile feel at every necessary wrist inclination, all while maintaining a suitable level of protection. The glove 2 allows freer flexion and extension, as well as radial and ulnar deviation, and dorsiflexion.

Variations and modifications of the embodiments described herein are considered within the scope and spirit of the invention. For example, the unitary dorsal padding array of the present invention may be inserted in compressed or uncompressed form within a pocket formed in the scrim material on the dorsal side of the glove 2. Such pocket would allow for easier construction, reducing labor costs, and may be better suited for an intermediate level of play. The pocket circumferential edges may be sewn to the palm and fingers with one side of the pocket left open to insert and receive the compressed dorsal panel.

The unitary dorsal padding array of the present invention provides these advantages and may also be used for helmet liners, head gear (e.g., wrestling), other specialty gloves (e.g., baseball, boxing, biking, golf, lacrosse, equestrian, hockey, etc.), shoulder pads, knee pads, elbow pads, bicycle seats, joint supports (e.g., elbow, wrist, knee, hip, neck, shoulder and ankle), padded garments (e.g., biker shorts, etc.), joint braces (e.g., elbow, wrist, knee, hip, neck, shoulder and ankle), and other general padding and supports.

The foregoing disclosure of embodiments of the present invention has been presented for purposes of illustration and description. It is not intended to be exhaustive or to limit the invention to the precise forms disclosed. Many variations and modifications of the embodiments described herein will be obvious to one of ordinary skill in the art in light of the above disclosure. The scope of the invention is to be defined only by the claims, and by their equivalents.

What is claimed is:

1. A protective sports glove, comprising:

a hand portion configured when worn by a user for covering the user's hand inclusive of fingers, thumb and carpometacarpal joints and configured when worn by said user to extend down at least to a wrist crease of said user's hand, said hand portion including a palmar side, a dorsal side, a first layer of scrim material and finger gussets; and a dorsal panel consisting solely of a second layer of molded foam fused to said scrim material and covering the dorsal side of said hand portion, said dorsal panel being molded to define a zero-elevation surface, a plurality of shock absorbing resilient cushions raised from said zero-elevation surface, and interstitial channels between each said shock-absorbing cushion, at least two of said plurality of shock absorbing cushions positioned when worn by said user adjacent said user's carpometacarpal joint and separated by an interstitial channel having a width of 1 mm or less;

wherein the dorsal panel covering said fingers comprises a substantially contiguous border framing the dorsal panel and having a width within a range of from 4-8 mm, said border being positioned within and attached to said finger gussets.

2. The protective sports glove according to claim 1, wherein said dorsal panel is attached to said first layer of scrim material by molding.

3. The protective sports glove according to claim 2, wherein said dorsal panel is attached to said scrim material by compression molding.

4. The protective sports glove according to claim 1, wherein said dorsal panel is attached to said first layer of scrim material by sonic welding.

5. The protective sports glove according to claim 1, further comprising a plurality of impact-resistant inserts configured for insertion into said plurality of shock absorbing cushions.

6. The protective sports glove according to claim 1, wherein said dorsal panel is EVA foam.

7. The protective sports glove according to claim 1, wherein said at least two carpometacarpal shock-absorbing cushions have trapezoidal cross sections.

8. The protective sports glove according to claim 1, wherein at least one of said plurality of shock absorbing cushions is defined by an angled upper surface.

9. The protective sports glove according to claim 1, wherein at least one of said plurality of shock absorbing cushions is defined by a curved upper surface.

10. A protective sports glove, comprising;

a hand portion configured when worn for covering a user's hand inclusive of fingers, thumb and carpometacarpal joints and extending down at least to a wrist crease of said user's hand, said hand portion including a palmar side, a dorsal side, and finger gussets, said hand portion further comprising, a first layer of scrim material, and a dorsal panel consisting solely of a second layer of molded foam fused to said scrim material and covering the entire dorsal side of the hand portion, said dorsal panel molded to define a zero-elevation surface, and a plurality of raised shock absorbing resilient pads protruding from said zero-elevation surface, and interstitial channels between each said shock-absorbing resilient pad, each said pad having an impact-absorbing thickness and each said interstitial channel having a minimal thickness less than or equal to 1 mm and functioning as a flexible hinge between adjacent shock absorbing resilient pads;

wherein said second layer of molded foam forms an outer surface of said protective sports glove.

11. The protective sports glove according to claim 10, wherein said dorsal panel is attached to said hand portion by molding.

12. The protective sports glove according to claim 10, wherein said dorsal panel is attached to said hand portion by compression molding.

13. The protective sports glove according to claim 10, wherein said dorsal panel is attached to said hand portion by sonic welding.

14. The protective sports glove according to claim 10, further comprising a plurality of impact-resistant inserts configured for insertion into said plurality of shock absorbing resilient pads.

15. The protective sports glove according to claim 10, wherein said dorsal panel consists of EVA foam.

* * * * *